US007997868B1

(12) United States Patent
Liang

(10) Patent No.: US 7,997,868 B1
(45) Date of Patent: Aug. 16, 2011

(54) FILM COOLING HOLE FOR TURBINE AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 536 days.

(21) Appl. No.: 12/273,443

(22) Filed: Nov. 18, 2008

(51) Int. Cl.
*F01D 5/08* (2006.01)

(52) U.S. Cl. ..... 416/97 R

(58) Field of Classification Search ..... 416/97 A, 416/97 R

See application file for complete search history.

(56) References Cited

U.S. PATENT DOCUMENTS 4,684,323 A * 8/1987 Field ..... 416/97 R
7,300,242 B2 * 11/2007 Liang ..... 415/115
7,374,401 B2 * 5/2008 Lee ..... 416/97 R

* cited by examiner

*Primary Examiner* — Chandra Chaudhari
(74) *Attorney, Agent, or Firm* — John Ryznic

(57) ABSTRACT

A turbine airfoil with a film cooling hole having a bell mouth shaped opening that has expansion in both the side walls and the downstream wall of from 15 to 25 degrees. The film cooling hole includes an expansion section formed with two long ribs and one short rib to form three inlets of equal cross sectional areas so that the flows into the three passages are the same. The short rib forms two middle passages to combine with two outer passages to form four exit passages for the film hole. The two side walls are curved outward in the stream-wise oriented film hole and have an expansion of from 0 to 5 degrees in the compound angled film hole.

16 Claims, 5 Drawing Sheets

Fig 12

Hot Gas Flow

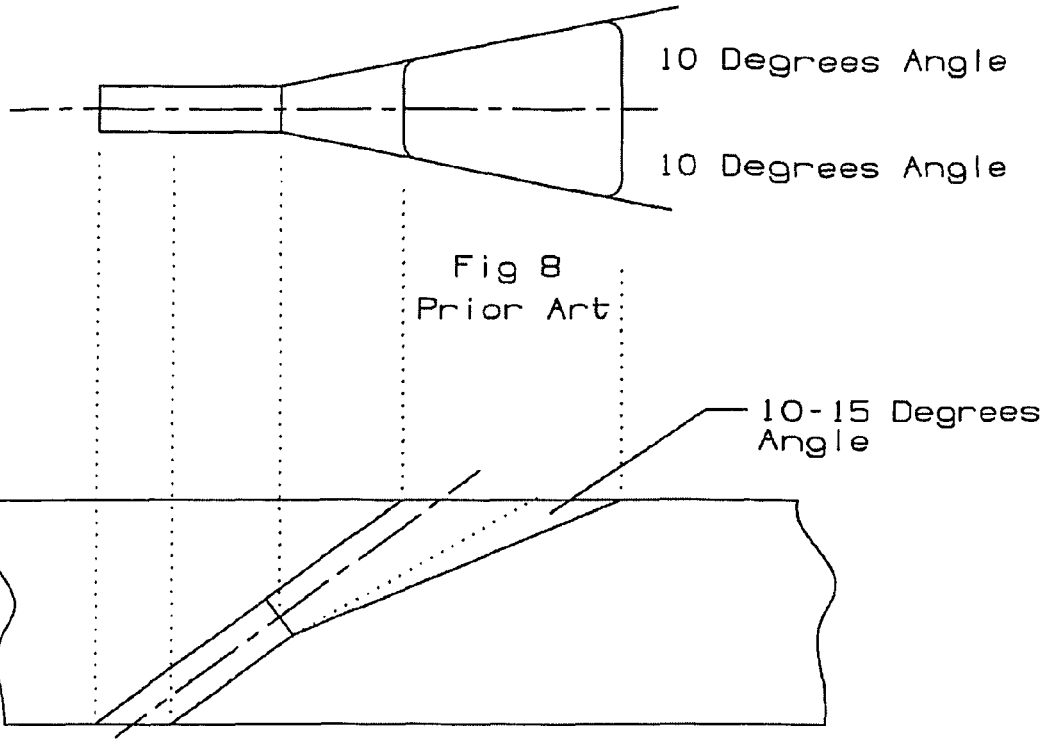
Fig 8
Prior Art
Fig 9
Prior Art
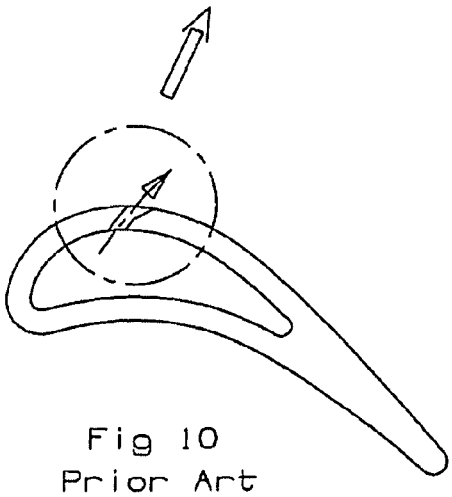
Fig 10
Prior Art

FILM COOLING HOLE FOR TURBINE AIRFOIL

FEDERAL RESEARCH STATEMENT

None.

CROSS-REFERENCE TO RELATED APPLICATIONS

None.

BACKGROUND OF THE INVENTION

Field of the Invention

The present invention relates generally to a gas turbine engine, and more specifically to an air cooled airfoil in the engine.

Description of the Related Art including information disclosed under 37 CFR 1.97 and 1.98

Airfoils used in a gas turbine engine, such as rotor blades and stator vanes (guide nozzles), require film cooling of the external surface where the hottest gas flow temperatures are found. The airfoil leading edge region is exposed to the highest gas flow temperature and therefore film cooling holes are used here. Film cooling holes discharge pressurized cooling air onto the airfoil surface as a layer that forms a blanket to protect the metal surface from the hot gas flow. The prior art is full of complex film hole shapes that are designed to maximize the film coverage on the airfoil surface while minimizing loses.

Standard film holes pass straight through the airfoil wall at a constant diameter and exit at an angle to the airfoil surface. This is shown in FIGS. 1 through 7. Some of the cooling are is ejected directly into the mainstream flow and causes turbulence, coolant dilution and a loss of downstream film effectiveness. Also, the hole breakout in the streamwise elliptical shape will induce stress problems in a blade application.

An improvement of the straight film hole is the diffusion hole shown in FIGS. 8 through 10 which is disclosed in U.S. Pat. No. 4,653,983 issued to Vehr on Mar. 31, 1987 and entitled CROSS-FLOW FILM COOLING PASSAGES, which discloses a film hole with 10×10×10 streamwise three dimension diffusion hole. This type of film cooling hole includes a constant cross section flow area at the entrance region for the cooling flow metering purpose. Downstream from the constant diameter section, is a diffusion section with diffusion in three sides that include the two side walls and the downstream wall in which each of these three walls have a diffusion angle of 10 degrees from the hole axis. However, in the Vehr hole there is no diffusion in the upstream side wall (the top wall in FIG. 9) in the streamwise direction. During the engine operation, hot gas frequently becomes entrained into the upper corner and causes shear mixing with the cooling air flowing through the hole. As a result of this, a reduction of the film cooling effectiveness for the film cooling hole occurs. Also, internal flow separation occurs within the diffusion hole at the junction between the constant cross section area and the diffusion region as seen by the arrow in FIG. 11.

BRIEF SUMMARY OF THE INVENTION

It is an object of the present invention to provide for a film cooling hole that will produce less turbulence than the citer prior art film holes.

It is another object of the present invention to provide for a film cooling hole that will produce less dilution of the film cooling air than the film holes of the cited prior art.

It is another object of the present invention to provide for a film cooling hole that will have a higher downstream film effectiveness than the film holes of the cited prior art.

It is another object of the present invention to provide for a film cooling hole that will produce less internal flow separation within the diffusion hole than the film hales of the cited prior art.

The film cooling hole of the present invention includes a metering section and a diffusion section that includes flow guides to form separate diffusion passages in order to minimize shear mixing between the cooling layers versus the hot gas stream. In one embodiment, three flow guides form four separate diffusion passages each having an expansion in both sideways and downstream walls of the passage. The two inner passages have the same flow area and the two outer passages have the same flow area at the exits. The middle flow guide is shorter than the two outer flow guides so that three inlets for the four passages are formed where all three inlets have the same flow area.

In a second embodiment used in a compound angled bell-mouth shaped film hole, four flow guides form five diffusion passages with an inner passage, two middle passages and two outer passages. Two inner flow guides are shorter than the two outer flow guides and form three inlets to the five passages. Each passage expands in both side wall directions and the downstream side wall direction. No expansion is formed in the upstream side wall.

BRIEF DESCRIPTION OF THE SEVERAL VIEWS OF THE DRAWINGS

FIG. 8 shows a top view of a prior art film cooling hole with the 10 by 10 by 10 expansions in three side walls.

FIG. 9 shows a cross section side view of the prior art film cooling hole of FIG. 8.

FIG. 10 shows a cross section view of an airfoil with one of the film cooling hole of FIG. 8 on the suction side wall.

DETAILED DESCRIPTION OF THE INVENTION

Figure 1:
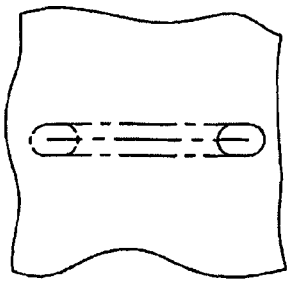
Fig 1 Prior Art
FIG. 1 shows a top view of a prior art straight film cooling hole.
Figure 2:
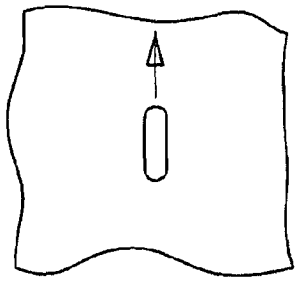
Fig 2 Prior Art
FIG. 2 shows a top view of a prior art radial film cooling hole.
Figure 3:
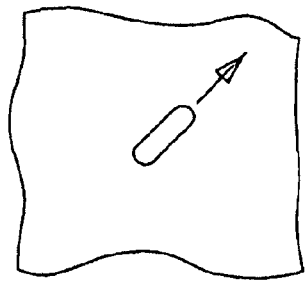
Fig 3 Prior Art
FIG. 3 shows a top view of a prior art compound angled film cooling hole.
Figure 4:
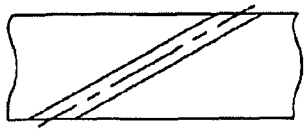
Fig 4 Prior Art
FIG. 4 shows a cross section view of the straight film hole of FIG. 1.
Figure 5:
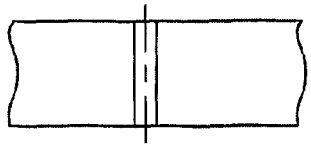
Fig 5 Prior Art
FIG. 5 shows a cross section view of the radial film hole of FIG. 2.
Figure 6:
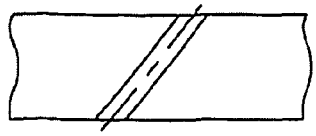
Fig 6 Prior Art
FIG. 6 shows a cross section view of the compound angled film hole of FIG. 3.
Figure 7:
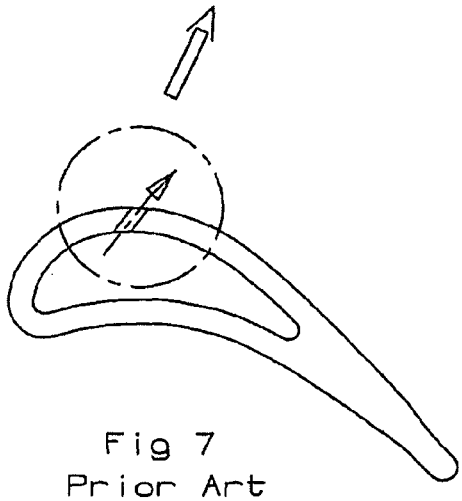
Fig 7 Prior Art
FIG. 7 shows a cross section view of an airfoil with one of the film cooling hole on the suction side wall.
Figure 11:
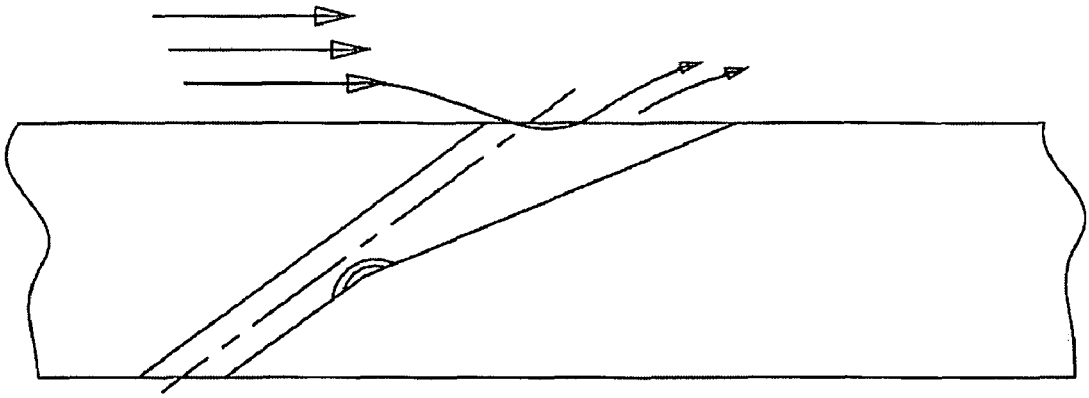
Fig 11 Prior Art
FIG. 11 shows a cross section side view of the prior art film cooling hole of FIG. 8 with the flow separation and hot gas ingestion.
Figures 12, 13:
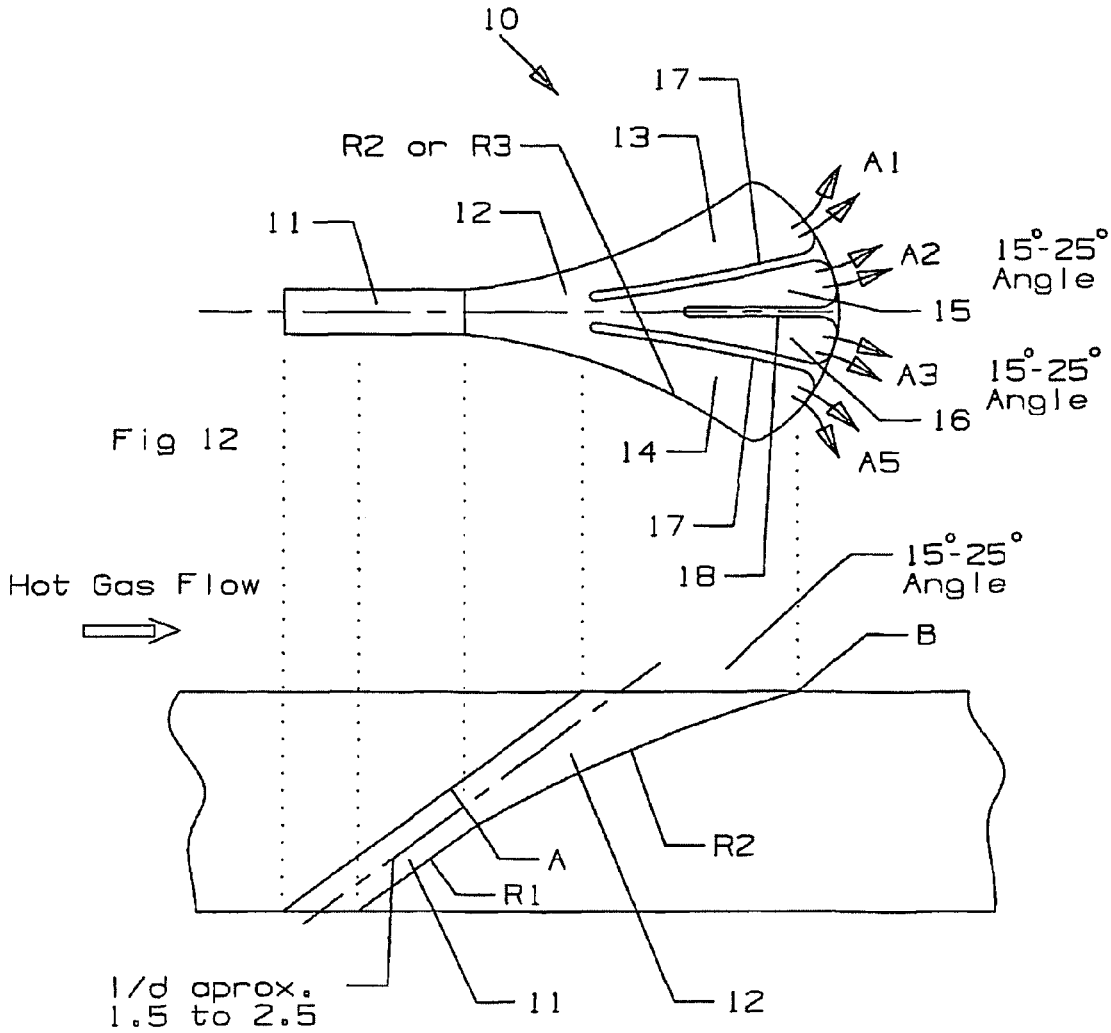
FIG. 12 shows a first-embodiment of the film cooling hole of the present invention from a top view.
FIG. 13 shows a first embodiment the film cooling hole of the present invention from a cross section side view.

The film cooling holes of the present invention are shown in FIGS. 12 through 15 where the first embodiment is shown in FIGS. 12 and 13. FIG. 12 shows the film cooling hole 10 with an inlet metering section 11 having a constant diameter and a diffusion section 12 located immediately downstream in the flow direction of the cooling air. The diffusion section 12 in this particular embodiment includes four separate passages formed by three flow guides. Two outer flow guides 17 form two outer diffusion passages 13 and 14 with the two side walls of the diffusion passage 12. An inner flow guide 18 forms two inner diffusion passages 15 and 16 with the two outer flow guides 17.

The inlet section 11 has a constant diameter along the length to provide for metering of the pressurized cooling air through the film hole 10. The downstream wall is shown in FIG. 13 to have a radius of curvature R1, but this curvature is infinite since this surface is flat and parallel to the upper wall surface of the rounded hole.

The diffusion passages 13-16 all have expansions in the two sideways directions and the downstream side wall as seen in FIG. 13 which has a radius of curvature R2 from point A to point B as shown in FIG. 13. The inner flow guide 18 is shorter than the two outer flow guides 17 so that only three inlets are formed for the four diffusion passages. The two inner diffusion passages 15 and 16 share a common inlet formed by the upstream ends of the two outer flow guides 17. The three inlets formed by the two outer flow guides have equal flow areas.

The outlets of the outer diffusion passages 13 and 14 have the same flow area. The outlets of the two inner diffusion passages 15 and 16 have the same flow area. The three ribs in FIG. 12 form four flow paths in the diffusion section that have four flow exit areas A1 through A4. The three inlets to the three passages (separated by the ribs 17) have the same cross sectional area for the same fluid flow entering the passages. The middle passage is further divided by a short rib 18 to form two channels between the longer ribs 17. The four diffusion passages 13-16 can have different outlet areas to regulate the film flow out from the passage. The flow in passage 13 is equal to $1/3^{rd}$ of the total flow through the inlet section 11, the flow through passage 14 is equal to $1/3^{rd}$ the total flow through the inlet section 11, and the flow in the two passages 15 and 16 combined is also equal to $1/3^{rd}$ the total flow through the inlet section 11. Thus, $2/3^{rd}$ of the total flow through the film cooling hole is discharged out the two side passages 13 and 14 to improve the film layer. In another embodiment, the outlet flow areas A1 to A4 could be all equal, or the outlet flow areas A2 and A3 can be larger than A1 and A4 to produce more flow at the center of the film cooling hole outlet.

Figure 14:
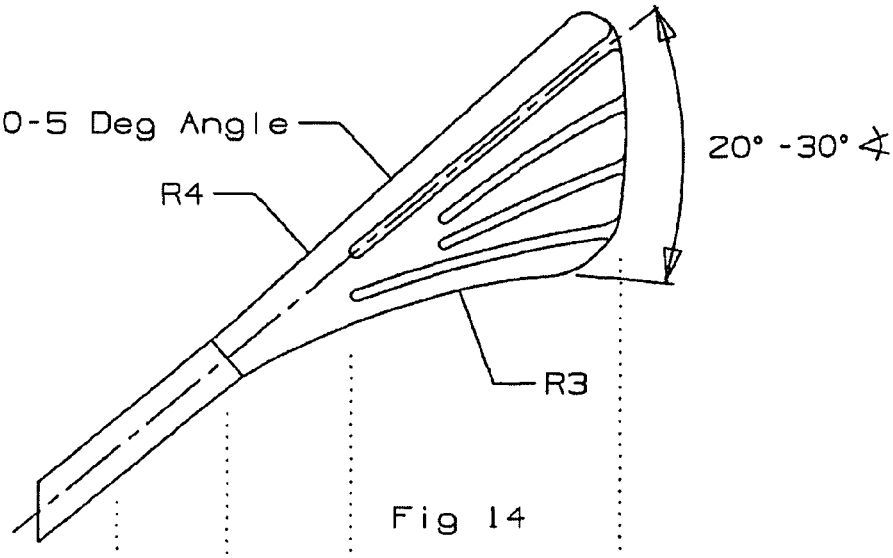
FIG. 14 shows a second embodiment of the film cooling hole of the present invention from a top view.
Figure 15:
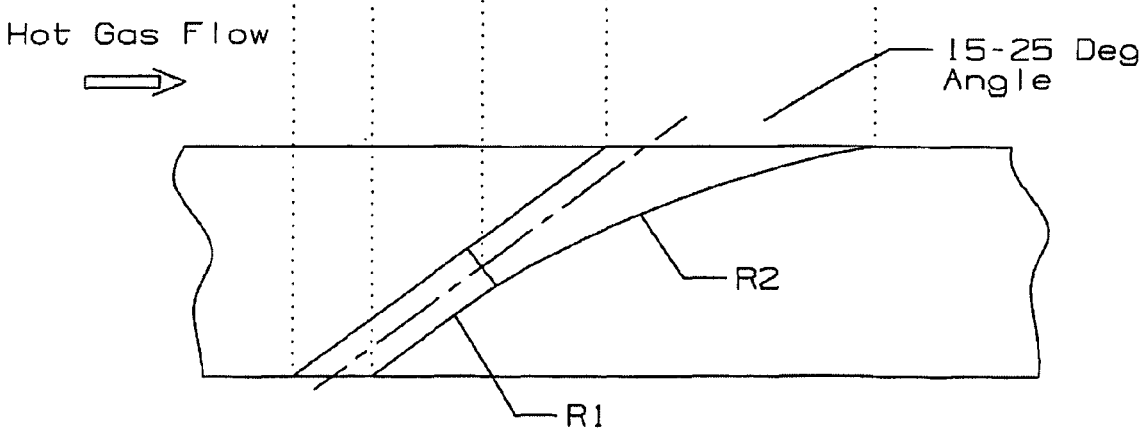
FIG. 15 shows a second embodiment the film cooling hole of the present invention from a cross section side view.

FIGS. 14 and 15 show a second embodiment of the film cooling hole in which the film hole is a compound angled film hole. FIG. 12 shows a top view of the film hole with the same basic shape as in the FIG. 12 film hole except the film hole is angled with respect to the hot gas flow path over the film hole. The left side wall has a 0 to 5 degree expansion while the right side wall has a radius of curvature of R3. Two outer ribs form three inlets to the diffusion section of the film hole, and two inner ribs of shorter length form three separate diffusion paths inside of the two outer ribs. The total angle of the film hole outlet is from 20 to 30 degrees which is the compound angle of the film hole. FIG. 13 shows a cross section side view of the film hole with the metering inlet section of constant diameter area followed by the diffusion section that has a downstream wall with a radius of curvature of R2 and an outlet angle of 1.5 to 25 degrees.

In the FIG. 12 embodiment, each individual inner wall of the film cooling hole is constructed with various radiuses of curvatures independent of each other. This unique film cooling hole construction will allow radial diffusion of the stream-wise oriented flow, combining the best aspects of both radial and stream-wise straight holes.

In the stream-wise direction, the straight wall at the upstream side of the film cooling hole has an infinite radius (straight) of curvature while the downstream side wall has a positive radius of curvature, which creates diffusion in the stream-wise flow direction. Also, the straight wall in the upstream flow direction has a built-in tapered flow guide that eliminates the hot gas entrainment problem of the prior art. The end product from the tapered flow guide in the upstream corner yields a diffusion film cooling hole at a much lower cooling injection angle. Thus, shear mixing between the cooling layers versus the hot gas stream is minimized which results in a better film layer at a higher effective level than in the prior art. The curved surfaces on the downstream wall are formed with a continuous arc connecting the point at the end of the metering section and the intersection between the expansion surfaces to the airfoil external wall. The radius of curvature for the lower surface is determined with the continuous arc tangent to the points A and cut through points B. the downstream surface for the film hole has an expansion of between 15 to 25 degrees toward the airfoil trailing edge.

The position of the exit flow guides is dependent on the film flow distribution requirement. It can be positioned at equal inlet area to obtain the same amount of film flow or one can position the flow guide at the large flow area for the corner channel than the middle channels. This allows for a higher film flow in the corner channels for the elimination of vortices formation underneath the film injection location.

In the spanwise direction, the radial outward and radial inward film cooling hole walls can be curved at the same radius of curvature. This increases the film cooling hole breakout and yields a better film coverage in the spanwise direction. This film cooling hole expansion, between 15 to 25 degrees, is valid only if the hole is oriented in the stream-wise direction or at a small compound angle at less than 20 degrees. However, if the cooling hole is used in a highly radial direction oriented application (greater than 40 degrees from the axial flow direction) then the radial outward surface for the film cooling hole has to be at a different radius of curvature than the radial inward surface. The radial outward surface will be at an expansion of less than 7 degrees. For this particular application, the radius of curvature for the inward wall can be much smaller than the outward surface and the expansion angle will from 20 to 30 degrees which is larger than the 15 to 25 degree expansion used for the stream-wise angled film hole. FIG. 12 shows details of the compound angled curved film cooling hole. The end product of this differential yields a stream-wise oriented cooling flow injection flow phenomena for a compound angled film cooling hole with a much larger film coverage.

I claim the following:

1. A film cooling hole for an air cooled turbine airfoil used in a gas turbine engine, the film cooling hole comprising:

An inlet section forming a metering section for the film cooling hole;

A diffusion section located downstream from the metering section;

The diffusion section having a downstream wall and two side walls all with a positive expansion;

The diffusion section including two long ribs forming three inlets of equal cross sectional flow area; and, The diffusion section including a short rib formed between the two long ribs, the short rib and the two long ribs forming two outlets.

2. The film cooling hole of claim 1, and further comprising:
The diffusion section forms a bell mouth shaped cross section.

3. The film cooling hole of claim 1, and further comprising:
The two side walls and the downstream wall of the diffusion section are curved outward from the center of the diffusion section.

4. The film cooling hole of claim 1, and further comprising:
The downstream wall has an expansion of from 15 to 25 degrees.

5. The film cooling hole of claim 1, and further comprising:
The two side walls have an expansion of from 15 to 25 degrees.

6. The film cooling hole of claim 5, and further comprising:
The long ribs and the short rib form an expansion of from 15 to 25 degrees.

7. The film cooling hole of claim 6, and further comprising:
The film cooling hole is a streamwise oriented film cooling hole.

8. The film cooling hole of claim 1, and further comprising:
The film cooling hole is a compound angled oriented film cooling hole.

9. The film cooling hole of claim 1, and further comprising:
The radial outer side wall has an expansion of from 0 to 5 degrees.

10. The film cooling hole of claim 9, and further comprising:
The radial inward side wall is curved outward to form passage outlets with a 20 to 30 degree angle from side wall to side wall.

11. An air cooled airfoil for a gas turbine engine, comprising:
The airfoil includes a plurality of film cooling holes of claim 1 to discharge a layer of film cooling air onto the outer airfoil surface.

12. The air cooled airfoil of claim 11, and further comprising:
The diffusion section of the film cooling hole forms a bell mouth shaped cross section.

13. The air cooled airfoil of claim 11, and further comprising:
The two side walls and the downstream wall of the diffusion section are curved outward from the center of the diffusion section.

14. The air cooled airfoil of claim 11, and further comprising:
The downstream wall has an expansion of from 15 to 25 degrees.

15. The air cooled airfoil of claim 11, and further comprising:
The two side walls have an expansion of from 15 to 25 degrees.

16. The air cooled airfoil of claim 15, and further comprising:
The long ribs and the short rib form an expansion of from 15 to 25 degrees.

* * * * *